US011970959B2

(12) United States Patent
Tang

(10) Patent No.: US 11,970,959 B2
(45) Date of Patent: Apr. 30, 2024

(54) VALVE ACTUATORS FOR SPECIALIZED STATIONARY TWO-PISTON HYDRAULIC ENGINES

(71) Applicant: JIANGSU JOINTEK PRECISION MACHINERY CO., LTD., Jiangsu (CN)

(72) Inventor: Huaxue Tang, Changzhou (CN)

(73) Assignee: JIANGSU JOINTEK PRECISION MACHINERY CO., LTD., Changzhou (CN)

( * ) Notice: Subject to any disclaimer, the term of this patent is extended or adjusted under 35 U.S.C. 154(b) by 0 days.

(21) Appl. No.: 18/485,338

(22) Filed: Oct. 12, 2023

(65) Prior Publication Data

US 2024/0044267 A1 Feb. 8, 2024

Related U.S. Application Data

(63) Continuation of application No. PCT/CN2022/089490, filed on Apr. 27, 2022.

(30) Foreign Application Priority Data

Nov. 25, 2021 (CN) ..... 202111411336.3

(51) Int. Cl.
*F01L 9/14* (2021.01)
*F01L 1/18* (2006.01)
(Continued)

(52) U.S. Cl.
CPC ..... *F01L 9/14* (2021.01); *F01L 1/181* (2013.01); *F01L 1/267* (2013.01); *F01L 1/46* (2013.01); *F01L 13/06* (2013.01)

(58) Field of Classification Search
CPC ... F01L 1/181; F01L 1/267; F01L 1/46; F01L 9/14; F01L 13/06
(Continued)

(56) References Cited

U.S. PATENT DOCUMENTS 6,125,828 A 10/2000 Hu
9,347,383 B2 * 5/2016 Janak ..... F02D 13/0203
(Continued)

FOREIGN PATENT DOCUMENTS

CN 102635417 A 8/2012
CN 102787880 A 11/2012
(Continued)

OTHER PUBLICATIONS

International Search Report in PCT/CN2022/089490 dated Aug. 2, 2022, 9 pages.
(Continued)

*Primary Examiner* — Jorge L Leon, Jr.
(74) *Attorney, Agent, or Firm* — Porus IP LLC

(57) ABSTRACT

The embodiments of the present disclosure provide a valve actuator for a specialized stationary two-piston hydraulic engine, including a specialized drive cam, an actuator, an oil drive line, and a control valve. A hydraulic linkage is maintained between a primary piston and a secondary piston when the control valve is open, and the oil drive line is drained through the control valve when the control valve is closed. In the present disclosure, by integrating the primary piston and the secondary piston in a specialized actuator, oil consumption is reduced, and with a design of the specialized drive cam, an optimized design of the valve actuator that operates independently of a positive valve mechanism is realized, thus reducing interference and influence of the valve actuator on an operation of the positive valve mechanism.

13 Claims, 10 Drawing Sheets

(51) Int. Cl.

| | |
|---|---|
| ***F01L 1/26*** | (2006.01) |
| ***F01L 1/46*** | (2006.01) |
| *F01L 13/06* | (2006.01) |

(58) Field of Classification Search
USPC ..... 123/90.12, 90.16, 90.4, 90.44
See application file for complete search history.

(56) References Cited

U.S. PATENT DOCUMENTS

| | | | |
|---|---|---|---|
| 2002/0157624 | A1 | 10/2002 | Janak |
| 2009/0199796 | A1 | 8/2009 | Hisada et al. |

FOREIGN PATENT DOCUMENTS

| | | | | | |
|---|---|---|---|---|---|
| CN | 105026703 | A | | 11/2015 | |
| CN | 105507974 | A | | 4/2016 | |
| CN | 112177702 | A | | 1/2021 | |
| CN | 112177703 | A | * | 1/2021 | ..... F01L 1/183 |
| CN | 112253280 | A | | 1/2021 | |
| CN | 113818943 | A | | 12/2021 | |
| JP | 2004190552 | A | | 7/2004 | |
| WO | 9706355 | A1 | | 2/1997 | |

OTHER PUBLICATIONS

Written Opinion in PCT/CN2022/089490 dated Aug. 2, 2022, 9 pages.

* cited by examiner

VALVE ACTUATORS FOR SPECIALIZED STATIONARY TWO-PISTON HYDRAULIC ENGINES

CROSS-REFERENCE TO RELATED APPLICATIONS

This application is a Continuation of International Application No. PCT/CN2022/089490, filed on Apr. 27, 2022, which claims priority to Chinese Patent Application No. 202111411336.3, filed on Nov. 25, 2021, the entire contents of each of which are hereby incorporated by reference.

TECHNICAL FIELD

The present disclosure relates to the technical field of valve actuators for engines, and in particular, to valve actuators for specialized stationary two-piston hydraulic engines.

BACKGROUND

The concept and operation of compression-released engine brakes are well-known in the heavy commercial vehicle industry. Factors such as cost, power, reliability, and engine change requirements often influence the decision to adopt an engine brake. There are several different types of compression-release engine brakes in practice, and an engine braking system is favored for its independence and high performance.

Existing valve actuators for engines integrated into valve mechanisms are mainly specialized or integrated rocker arm brakes. Most of these rocker arm brakes swing partially or completely with other moving parts in the valve mechanism when in use or closed, thus requiring additional wear and biasing devices, which increases complexity and cost of the system. When a rocker arm brake opens a brake valve (drive valve), a lateral load may be formed on the brake valve by a swing of a rocker arm, causing excessive wear and damage to the valve, which in turn affects engine performance and reliability.

Therefore, it is necessary to provide an improved valve actuator for a specialized stationary two-piston hydraulic engine to reduce valve wear.

SUMMARY

A technical problem to be solved by the present disclosure is: in order to solve problems of the existing technology in which a rocker arm brake swings with other moving parts in a valve mechanism, requiring additional wear and biasing devices, and bias wear and fracture failure caused by lateral loads on valves, a valve actuator for a specialized stationary two-piston hydraulic engine is provided.

A technical solution provided by the present disclosure for solving the technical problem is a valve actuator for a specialized stationary two-piston hydraulic engine, including a specialized driving cam, disposed on a side of a positive cam of the engine, with a round base component and a drive lift cam disposed on the round base component, the positive cam being used to displace a valve bridge by means of a positive rocker arm; an actuator, provided with a primary piston slidably mounted in a primary piston hole and a secondary piston slidably mounted in a secondary piston hole; an oil drive line, maintained in communication between the primary piston hole and the secondary piston hole; and a control valve, the oil drive line being connected to an oil supply line through the control valve. In a condition in which the oil supply line supplies oil to the oil drive line and the control valve is open, when the specialized drive cam is rotated to the round base component for sliding or rolling engagement with the primary piston, the primary piston extending under hydraulic pressure of the oil drive line to contact the round base component. When the specialized drive cam is rotated to the drive lift cam for sliding or rolling engagement with the primary piston, the control valve blocks the oil drive line from the oil supply line, and a hydraulic linkage is formed between the primary piston and the secondary piston, and the drive lift cam displacing the secondary piston through the primary piston so that the secondary piston provides power for a drive valve of the engine to move relative to the valve bridge. In a condition in which the control valve is closed, the oil drive line is drained through the control valve, and the hydraulic linkage between the primary piston and the secondary piston is released.

In order to avoid wear and tear between the actuator and a rocker arm shaft, and to reduce noise, further, the actuator is fixedly connected to the rocker arm shaft. That is, the actuator does not swing with the specialized drive cam, thereby avoiding kinematic wear between the actuator and the rocker arm shaft due to rotation, and increasing engine output power.

In order to facilitate manufacturing and simplify an assembly process, further, the actuator is provided with a shaft hole matching the rocker arm shaft, the rocker arm shaft passes through the shaft hole, the valve actuator is connected to a positioning pin, and the valve actuator is fixedly connected to the rocker arm shaft through the positioning pin.

In order to reduce the wear between the specialized drive cam and the primary piston, as well as to reduce noise, furthermore, the actuator is provided with an active elastic element, the active elastic element being used to drive the primary piston to retract when the oil drive line is drained. By providing the active elastic element, the specialized drive cam is separated from the primary piston when it is not in operation, which effectively reduces the wear between the specialized drive cam and the primary piston and the noise of the engine, and lowers friction loss and improves an engine output power. The specialized drive cam may make the primary piston overcome an elastic force of the active elastic element to extend and contact the specialized drive cam through filling of the oil drive line when the specialized drive cam is in operation. Thus, the primary piston extends or retracts automatically with or without constructing the hydraulic linkage, without complex control, drive lift of the specialized drive cam is not affected by the initial gap setting, which is stable and consistent, and simple to use and maintain.

In order to improve opening accuracy of the drive valve, further, the valve actuator is provided with a follower elastic element used to move the secondary piston in a direction away from the drive valve, the follower elastic element is capable of overcoming oil pressure on the secondary piston during the filling of the oil drive line, maintaining the secondary piston in a retracted position, and driving the secondary piston to retract during draining of the oil drive line.

In order to prevent the drive line from accumulating excessive oil and causing a problem of over-traveling of the secondary piston, further, a safety oil drain hole is provided on an inner peripheral wall of the secondary piston hole. When the secondary piston moves between a retracted position and a maximum extended position, the secondary piston blocks the safety oil drain hole and the oil drive line is not connected to the safety oil drain hole. When the secondary piston moves beyond the maximum extended position, the secondary piston does not block the safety oil drain hole, and the oil drive line is connected to the safety oil drain hole through the secondary piston hole.

The valve actuator further includes a follower pin provided opposite to the secondary piston, the drive valve being connected to the follower pin. In a condition in which the oil supply line supplies oil to the oil drive line and the control valve is open, when the specialized drive cam is rotated to the round base component for sliding or rolling engagement with the primary piston, the secondary piston is separated from the follower pin; and when the specialized drive cam is rotated for sliding or rolling engagement with the primary piston, the secondary piston move until contacts with the follower pin and displaces the drive valve by pushing through the follower pin. Providing the follower elastic element overcomes oil pressure on the secondary piston during the filling of the oil drive line, maintaining the secondary piston in the retracted position and being separated from the follower pin. And only when the specialized drive cam displaces the primary piston to displace the secondary piston through the hydraulic linkage, the secondary piston may overcome an elastic force of the follower elastic element to extend to contact and displace the follower pin, making the drive valve connected to the follower pin move to open. In order to improve the opening accuracy of the drive valve, furthermore, the actuator is provided with an adjusting bolt for adjusting a position of the secondary piston.

In order to achieve a precise hydraulic linkage, further, the control valve is provided so that when the control valve is open, the oil supply line supplies oil to the oil drive line uni-directionally through the control valve.

In order to facilitate operating opening and closing of the control valve, further, the oil supply line includes a control oil supply line and a drive oil supply line, the drive oil supply line supplying oil uni-directionally to the oil drive line through the control valve.

The control oil supply line is used to provide different forces to the control valve to realize the opening or closing of the control valve when internal oil pressure changes.

In order to realize a unidirectional oil supply function and a pressure relief function of the control valve, further, the control valve includes a valve body, an elastic return element, and a one-way mechanism. The valve body is provided with a primary oil line, a secondary oil line, and a connecting line, and the valve body is slidably mounted in a valve hole. The primary oil line is connected to the secondary oil line through the connecting line, the one-way mechanism is provided in the connecting line for permitting unidirectional entry of oil in the primary oil line into the secondary oil line, and the elastic return element is used for driving the valve body to reset. An oil drain line is provided in the valve actuator or the rocker arm shaft, the control oil supply line being connected to an end of the valve hole. When pressure on the valve body of oil passed into the valve hole by the control oil supply line is greater than an elastic force of the elastic return element, the valve body is in an open position, the drive oil supply line is connected to the primary oil line, the secondary oil line is connected to the oil drive line, and the oil drive line is not connected to the oil drain line, which is an opening state of the control valve. When the pressure on the valve body of oil passed into the valve hole by the control oil supply line is less than the elastic force of the elastic return element, the elastic return element drives the valve body to move to a closed position, and the oil drive line is connected to the oil drain line, which is a closing state of the control valve.

Further, a pressure relief chamber is formed between the valve body and the valve hole, and when the valve body is in the closed position, the oil drive line is connected to the oil drain line through the pressure relief chamber. Or, the valve body is provided with the pressure relief chamber, and when the valve body is in the closed position, the oil drive line is connected to the oil drain line through the pressure relief chamber.

Further, the control valve is mounted on the rocker arm shaft or the valve actuator.

Beneficial effects of the present disclosure are that the valve actuator for the specialized stationary two-piston hydraulic engine of the present disclosure adopts a manner that integrates the primary piston and the secondary piston in a specialized actuator, which reduces oil consumption. And with a design of the specialized drive cam, an optimized design of the valve actuator that operates independently of a positive valve mechanism is realized, thus reducing interference and influence of the valve actuator on an operation of the positive valve mechanism. The secondary piston transmits a driving force to a drive valve completely along a movement direction of the valve, thus avoiding a lateral load on the drive valve. A mounting position of the actuator is not affected by a position of the drive valve, which facilitates flexible arrangement.

BRIEF DESCRIPTION OF THE DRAWINGS

The present disclosure is further illustrated in terms of exemplary embodiments. These exemplary embodiments are described in detail according to the drawings. These embodiments are non-limiting exemplary embodiments, in which like reference numerals represent similar structures, wherein.

Figure 1:
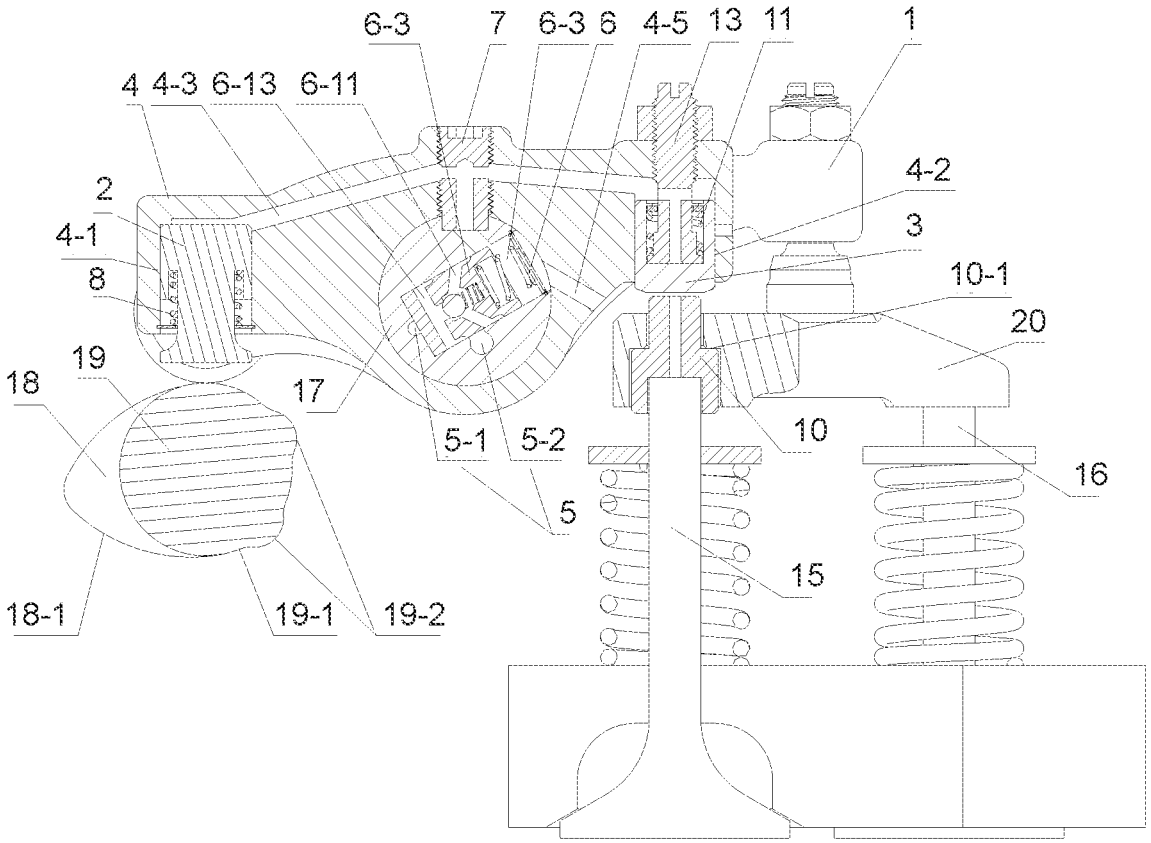
FIG. 1 is a schematic diagram illustrating a valve actuator for a specialized stationary two-piston hydraulic engine when an oil drive line is drained according to some embodiments of the present disclosure.

The accompanying markings illustrate: 1. positive rocker arm, 2. primary piston, 3. secondary piston;

- 4, actuator, 4-1, primary piston hole, 4-2, secondary piston hole, 4-3, oil drive line, 4-4, shaft hole, 4-5, oil drain line, 4-6, safety oil drain hole;
- 5. oil supply line, 5-1, control oil supply line, 5-2, drive oil supply line;
- 6, control valve, 6-1, valve body, 6-11, secondary oil line, 6-12, connecting line, 6-13, primary oil line, 6-2, elastic return element, 6-3, pressure relief chamber, 6-4, elastic element, 6-5, one-way ball;
- 7, positioning pin, 8, active elastic element, 9, active limiting element, 10, follower pin, 10-1, step surface, 11, follower elastic element, 12, follower limiting element, 13, adjusting bolt, 15, drive valve, 16, non-drive valve;
- 17, rocker arm shaft, 17-1, valve hole;
- 18, positive cam, 18-1, primary lift cam;
- 19, a specialized drive cam, 19-1, around base component, 19-2, drive lift cam; and
- 20. valve bridge.

DETAILED DESCRIPTION

The present disclosure is now described in further detail in connection with the accompanying drawings. These accompanying drawings are simplified schematic drawings illustrating a basic structure of the present disclosure in a schematic manner only, and as such they show only compositions relevant to the present disclosure, and the orientations and references (e.g., up, down, left, right, etc.) may be used only to aid in the description of the features in the accompanying drawings. Accordingly, the following specific embodiments are not adopted in a restrictive sense and the scope of the subject matter for which protection is sought is limited only by the appended claims and their equivalent forms.

To more clearly illustrate the technical solutions related to the embodiments of the present disclosure, a brief introduction of the drawings referred to the description of the embodiments is provided below. Obviously, the drawings described below are only some examples or embodiments of the present disclosure. Those having ordinary skills in the art, without further creative efforts, may apply the present disclosure to other similar scenarios according to these drawings. Unless obviously obtained from the context or the context illustrates otherwise, the same numeral in the drawings refers to the same structure or operation.

As shown in the present disclosure and claims, unless the context clearly dictates otherwise, the words "a", "an", "one" and/or "the" are not intended to be specific in the singular and may include the plural. In general, the terms "comprise," "comprises," "comprising," "include," "includes," and/or "including," merely prompt to include operations and elements that have been clearly identified, and these operations and elements do not constitute an exclusive listing. The methods or devices may also include other operations or elements.

Figure 2:
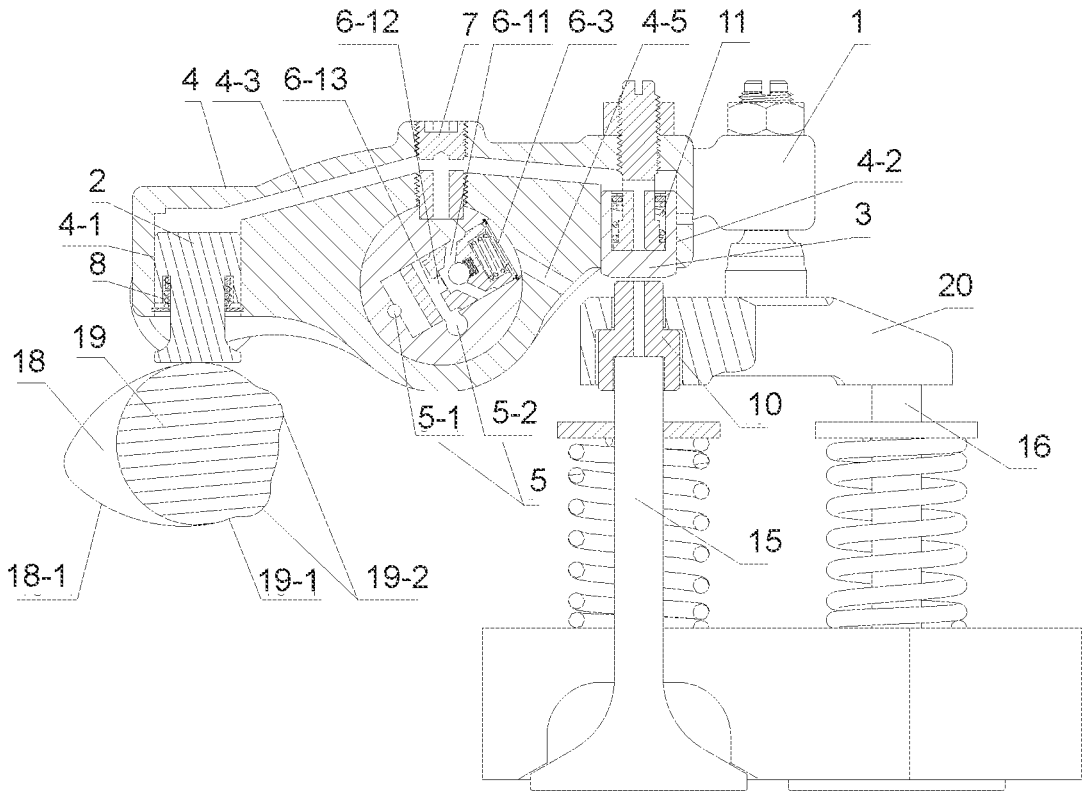
FIG. 2 is a schematic diagram illustrating forming of a hydraulic linkage between a primary piston and a secondary piston according to some embodiments of the present disclosure.
Figure 3:
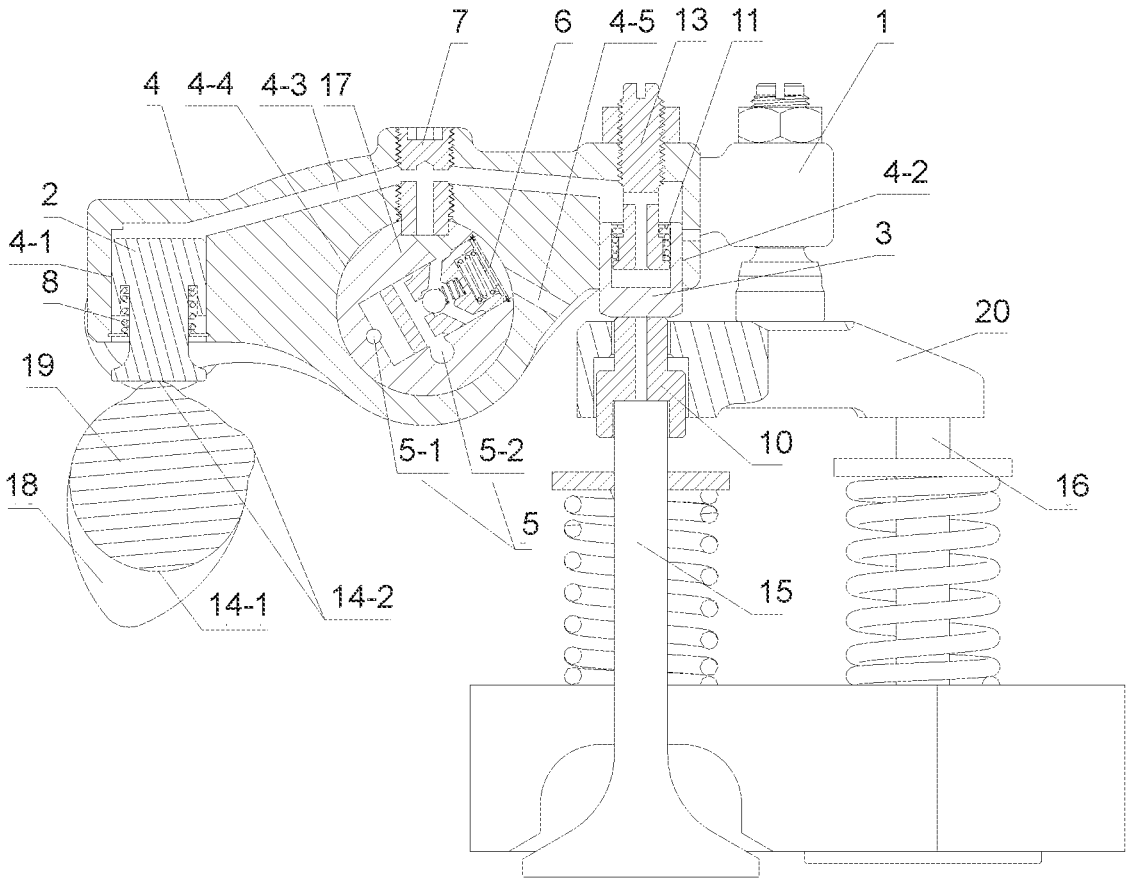
FIG. 3 is a schematic diagram illustrating displacement of a drive valve driven by a specialized drive cam according to some embodiments of the present disclosure.
Figure 4:
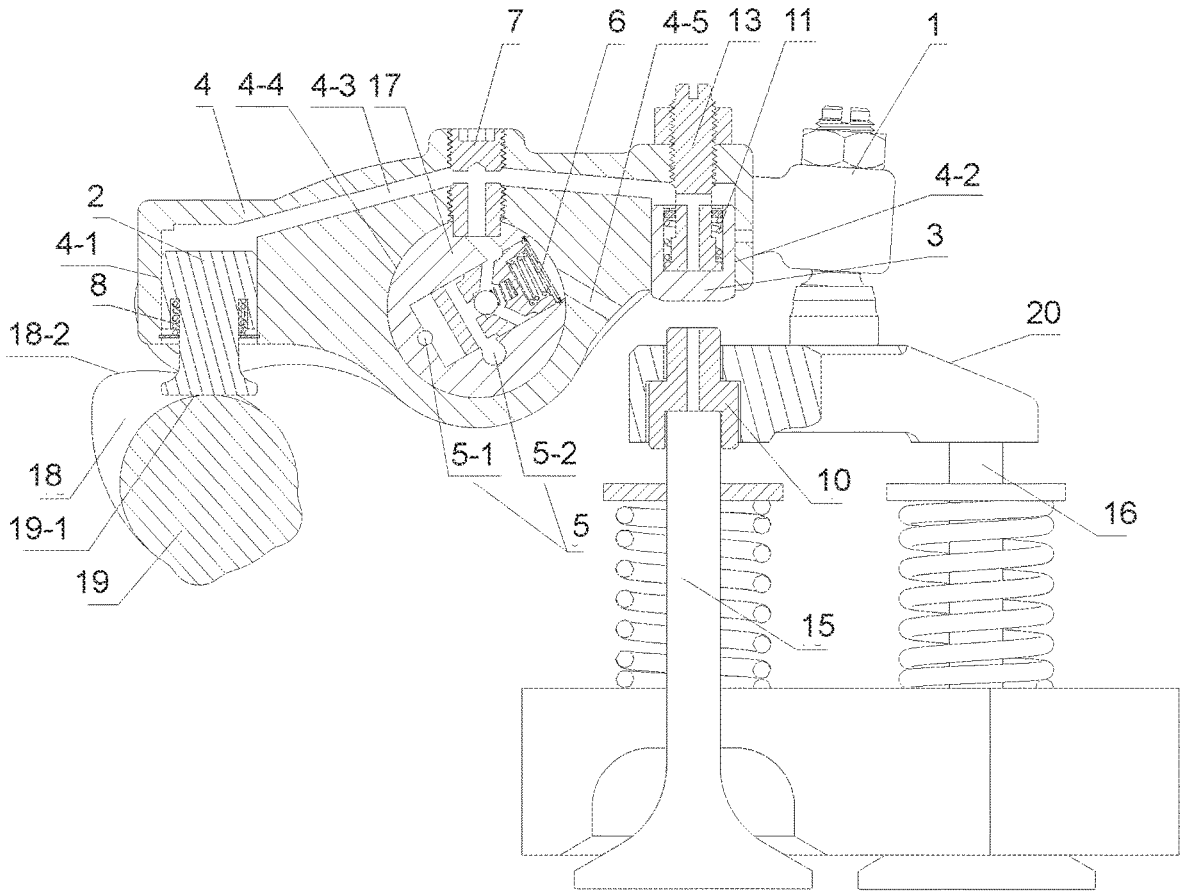
FIG. 4 is a schematic diagram illustrating displacement of a valve bridge driven by a positive cam according to some embodiments of the present disclosure.
Figure 5:
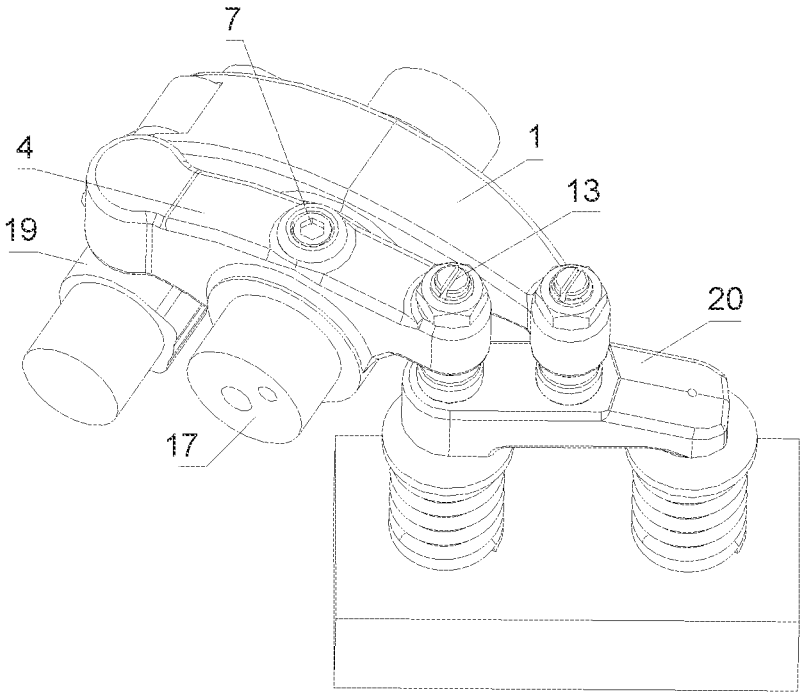
FIG. 5 is a three-dimensional schematic diagram illustrating a valve actuator for a specialized stationary two-piston hydraulic engine according to some embodiments of the present disclosure.
Figure 6:
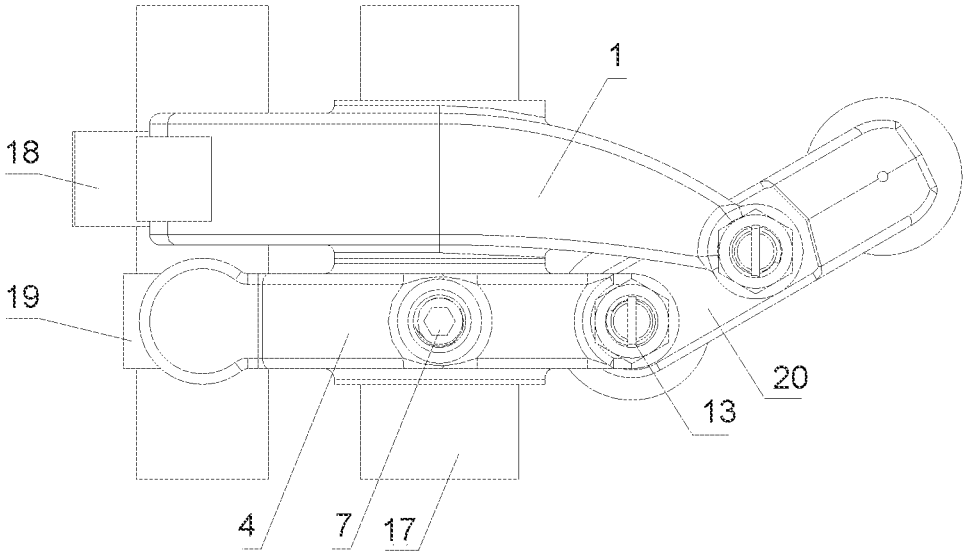
FIG. 6 is a top-view schematic diagram illustrating a valve actuator for a specialized stationary two-piston hydraulic engine according to some embodiments of the present disclosure.

FIG. 1 is a schematic diagram illustrating a valve actuator for a specialized stationary two-piston hydraulic engine when an oil drive line is drained according to some embodiments of the present disclosure. FIG. 2 is a schematic diagram illustrating forming of a hydraulic linkage between a primary piston and a secondary piston according to some embodiments of the present disclosure. FIG. 3 is a schematic diagram illustrating displacement of a drive valve driven by a specialized drive cam according to some embodiments of the present disclosure. FIG. 4 is a schematic diagram illustrating displacement of a valve bridge driven by a positive cam according to some embodiments of the present disclosure. FIG. 5 is a three-dimensional schematic diagram illustrating a valve actuator for a specialized stationary two-piston hydraulic engine according to some embodiments of the present disclosure. FIG. 6 is a top-view schematic diagram illustrating a valve actuator for a specialized stationary two-piston hydraulic engine according to some embodiments of the present disclosure. As shown in FIGS. 1-6, an engine of the valve actuator for the specialized stationary two-piston hydraulic engine is a four-stroke engine, a drive valve 15 and a non-drive valve 16 in a valve group are both exhaust valves in the engine, and a positive cam 18 is mounted on a camshaft of the engine.

In some embodiments, a positive valve mechanism refers to a structure in which the positive cam 18 of the engine displaces a valve bridge 20 through a positive rocker arm 1, as is conventional. For example, when the positive cam 18 is rotated until a round base fits the positive rocker arm 1, neither the positive rocker arm 1 nor the valve bridge 20 is displaced. When the positive cam 18 is rotated to the primary lift cam 18-1 for engagement with the positive rocker arm 1, the primary lift cam 18-1 pushes the positive rocker arm 1 to displace the valve bridge 20, thereby displacing both the drive valve 15 and the non-drive valve 16 by the valve bridge 20 to simultaneously open the drive valve 15 and the non-drive valve 16.

In some embodiments, the valve actuator includes:

a specialized drive cam 19, mounted on the camshaft and located on a side of the positive cam 18 of the engine, and the specialized drive cam 19 having a round base component 19-1 and a drive lift cam 19-2 disposed on the round base component 19-1. Specifically, there are two drive lift cams 19-2, which are an exhaust gas recirculation drive lift cam 19-2 and a compression release drive lift cam 19-2, wherein the exhaust gas recirculation drive lift cam 19-2 is configured to make the drive valve 15 perform an exhaust gas recirculation operation, and the compression release drive lift cam 19-2 is configured to make the drive valve 15 perform a compression release operation.

In some embodiments, the valve actuator includes: an actuator 4, which is provided with a primary piston 2 slidably mounted in a primary piston hole 4-1 and a secondary piston 3 slidably mounted in a secondary piston hole 4-2.

In some embodiments, the valve actuator includes: the oil drive line 4-3, which is opened in the actuator 4 and maintained in communication between the primary piston hole 4-1 and the secondary piston hole 4-2.

Figure 9:
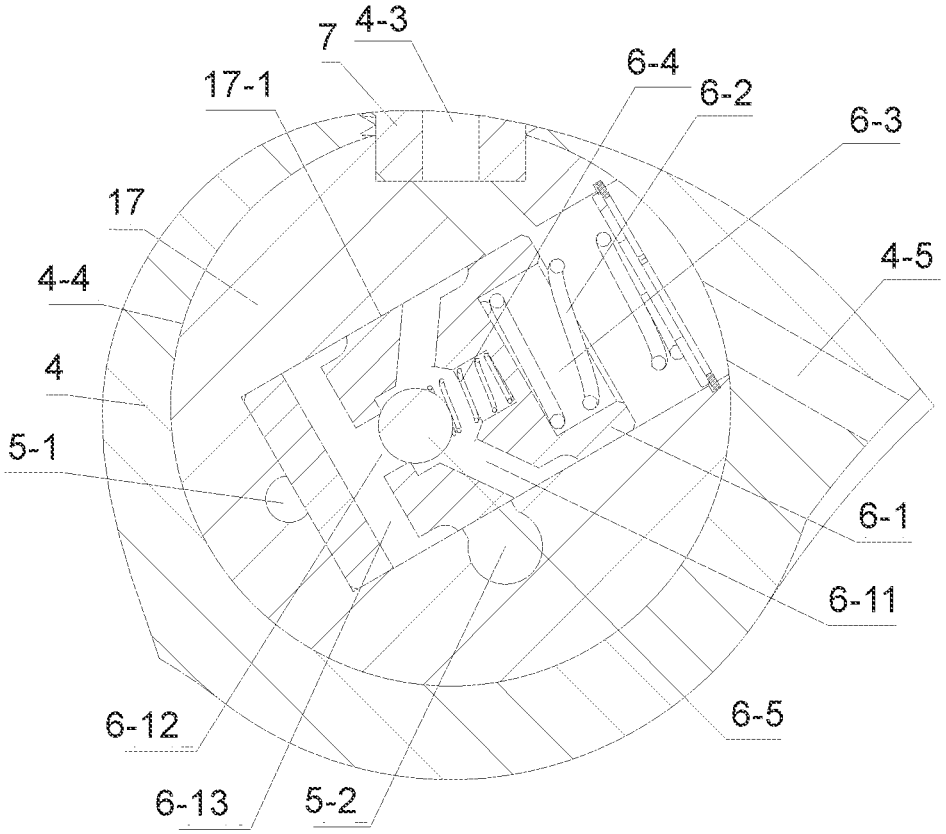
FIG. 9 is a schematic diagram illustrating a control valve mounted on an actuator according to some embodiments of the present disclosure.

In some embodiments, the valve actuator includes: a control valve 6, which is mounted on a rocker arm shaft 17 or the actuator 4, e.g., the control valve 6 is integrated into the rocker arm shaft 17, which may save space. FIG. 9 is a schematic diagram illustrating a control valve mounted on an actuator according to some embodiments of the present disclosure. The oil drive line 4-3 is connected to the oil supply line 5 through the control valve 6.

In some embodiments, in a condition in which the oil supply line 5 supplies oil to the oil drive line 4-3 and the control valve 6 is open, and when the specialized drive cam 19 is rotated to the round base component 19-1 for sliding or rolling engagement with the primary piston 2, the primary piston 2 extends to contact the round base component 19-1 under hydraulic pressure of the drive line 4-3. When the specialized drive cam 19 is rotated to the drive lift cam 19-2 for sliding or rolling engagement with the primary piston 2, the control valve 6 blocks the oil drive line 4-3 from the oil supply line 5, and a hydraulic linkage is formed between the primary piston 2 and the secondary piston 3, and the drive lift cam 19-2 displaces the secondary piston 3 through the primary piston 2 so that the secondary piston 3 provides power for the drive valve 15 of the engine to move force relative to the valve bridge 20. Specifically, the secondary piston 3 may push the drive valve 15 to displace the drive valve 15 to open the drive valve 15 in a state in which the positive rocker arm 1 of the engine has not displaced the valve bridge 20.

When the control valve 6 is in a closing state, the oil drive line 4-3 is drained through the control valve 6, and the hydraulic linkage between the primary piston 2 and the secondary piston 3 is released.

In some embodiments, the actuator 4 is fixedly connected to the rocker arm shaft 17. For example, the actuator 4 is provided with a shaft hole 4-4 matching the rocker arm shaft 17, and the rocker arm shaft 17 passes through the shaft hole 4-4. The actuator 4 is threaded with a positioning pin 7, and the positioning pin 7 may fix the actuator 4 to the rocker arm shaft 17 by either resisting against a peripheral wall of the rocker arm shaft 17 or being embedded in the rocker arm shaft 17. The oil drive line 4-3 may then pass through the positioning pin 7 or not.

Figure 7:
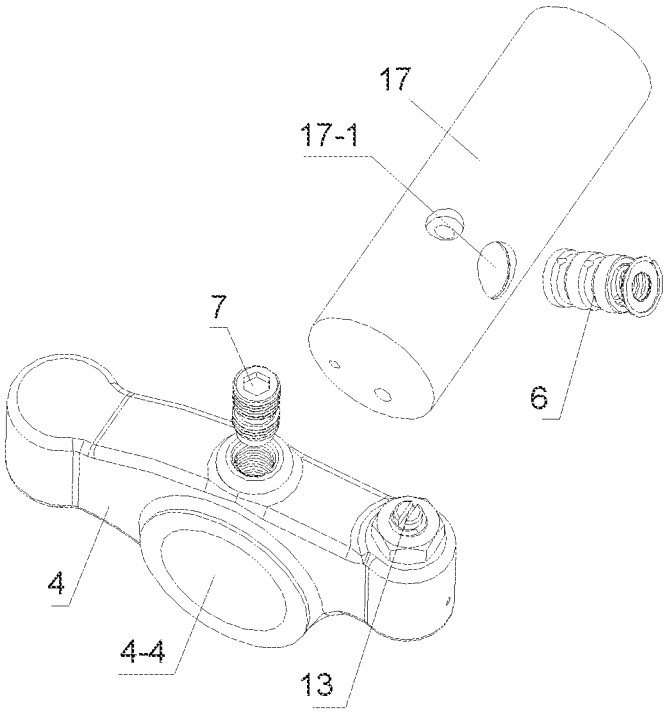
FIG. 7 is an exploded schematic view illustrating engagement of an actuator, a control valve, and a rocker arm shaft according to some embodiments of the present disclosure.
Figure 8:
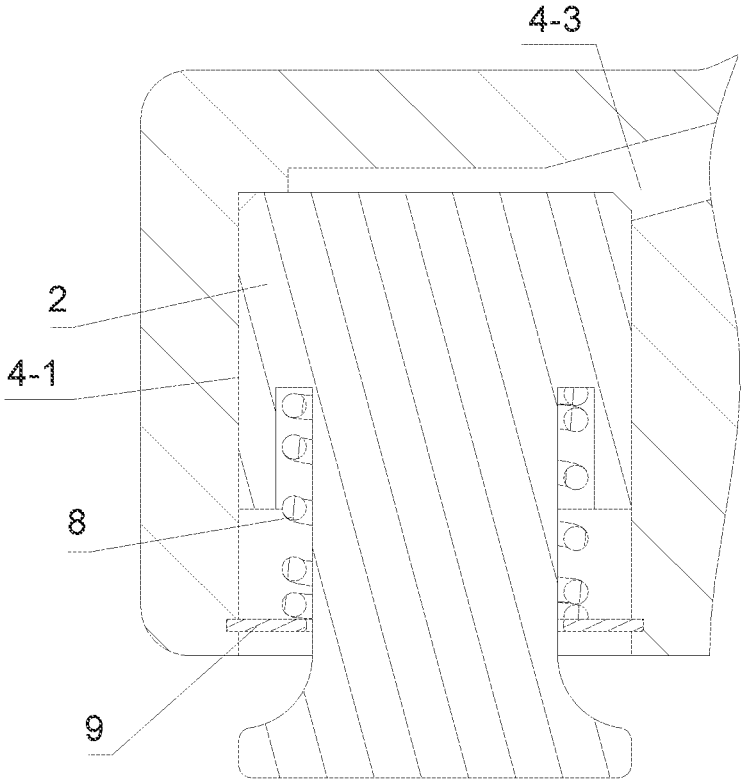
FIG. 8 is a schematic diagram illustrating a primary piston mounted on an actuator according to some embodiments of the present disclosure.

FIG. 7 is an exploded schematic view illustrating engagement of an actuator, a control valve, and a rocker arm shaft according to some embodiments of the present disclosure. FIG. 8 is a schematic diagram illustrating a primary piston mounted on an actuator according to some embodiments of the present disclosure. In some embodiments, as shown in FIG. 7 and FIG. 8, the actuator 4 is provided with an active elastic element 8 for driving the primary piston 2 to retract when the oil drive line 4-3 is drained.

In some embodiments, when the control valve 6 is open, the primary piston 2 may extend under hydraulic pressure to contact the specialized drive cam 19. When the control valve 6 is closed, the primary piston 2 is retracted by the active elastic element 8 until it is separated from the specialized drive cam 19. The active elastic element 8 may be a compression spring and mounted in a plurality of feasible mounting manners. An exemplary mounting structure may include an opening of the primary piston hole 4-1 facing downward, an active limiting element 9 fixed to a lower end of the primary piston 2, one end of the active elastic element 8 resting against the active limiting element 9 and the other end resting against the primary piston 2, and the primary piston 2 reaching a maximum stroke of downward displacement when the primary piston 2 contacts with the active limiting element 9.

Figure 10:
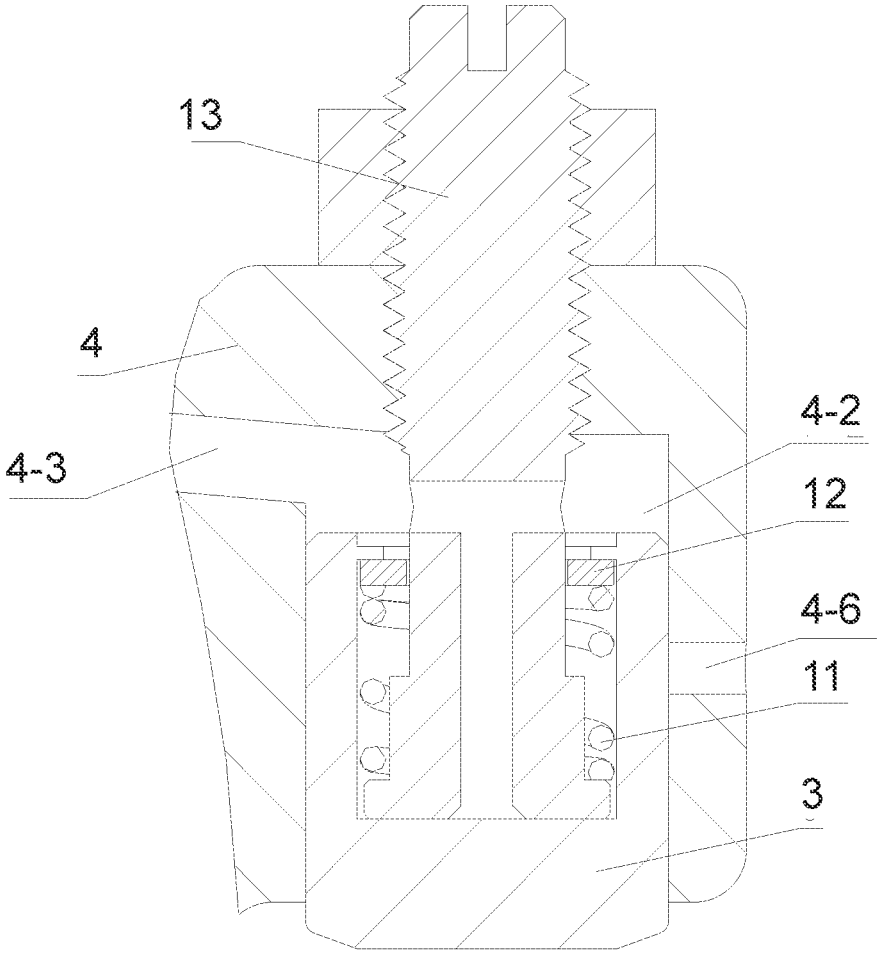
FIG. 10 is a schematic diagram illustrating a secondary piston mounted on an actuator according to some embodiments of the present disclosure.

FIG. 10 is a schematic diagram illustrating a secondary piston mounted on an actuator according to some embodiments of the present disclosure. In some embodiments, as shown in FIG. 10, the actuator 4 in this embodiment is provided with a follower elastic element 11 for displacing the secondary piston 3 in a direction away from the drive valve 15, and the follower elastic element 11 is required to be able to overcome oil pressure on the secondary piston 3 during filling of the oil drive line 4-3 and maintain the secondary piston 3 in a retracted position, and to drive the secondary piston 3 to retract during draining of the oil drive line 4-3.

In some embodiments, a safety oil drain hole 4-6 is provided in an inner peripheral wall of the secondary piston hole 4-2.

In some embodiments, when the secondary piston 3 moves between the retracted position and a maximum extended position, the secondary piston 3 blocks the safety oil drain hole 4-6, and the oil drive line 4-3 is not connected to the safety oil drain hole 4-6.

In some embodiments, when the secondary piston 3 moves beyond the maximum extended position, the secondary piston 3 does not block the safety oil drain hole 4-6, and the oil drive line 4-3 is connected to the safety oil drain hole 4-6 through the secondary piston hole 4-2 to remove excess oil accumulated in the oil drive line 4-3.

In some embodiments, a follower pin 10 is also provided opposite to the secondary piston 3, and the drive valve 15 is attached to the follower pin 10. Merely by way of example, the follower pin 10 is of a stepped construction, a step surface 10-1 of the follower pin 10 resists against a lower side of the valve bridge 20, an upper end of the follower pin 10 projects over an upper side of the valve bridge 20, an upper end of the drive valve 15 resists against the follower pin 10, and an upper end of the non-actuated valve 16 resists against the valve bridge 20.

In a condition in which the oil supply line 5 supplies oil to the drive line 4-3 and the control valve 6 is open, when the specialized drive cam 19 is rotated to the round base component for sliding or rolling engagement with the primary piston 2, the secondary piston 3 is separated from the follower pin 10. When the specialized drive cam 19 is rotated to the drive lift cam 19-2 for sliding or rolling engagement with the primary piston 2, the secondary piston 3 may move until contact with the follower pin 10 and displace the drive valve 15 by the follower pin 10.

In some embodiments, the actuator 4 is provided with an adjusting bolt 13 for adjusting a position of the secondary piston 3. For example, the adjusting bolt 13 is threaded to the actuator 4 and fixed to the actuator 4 with a lock nut, thus a position of the adjusting bolt 13 and the position of the secondary piston 3 may be adjusted. In some embodiments, the follower elastic element 11 may be a compression spring, and the follower elastic element 11 may be mounted in a plurality of feasible ways. An exemplary mounting structure may include an opening of the secondary piston hole 4-2 facing downward, an upper end of the secondary piston 3 fixed with the follower limiting element 12, a lower end of the adjusting bolt 13 extending into the secondary piston 3, an upper end of the follower elastic element 11 resisting against the follower limiting element 12, and a lower end of the follower elastic element 11 resisting against the lower end of the adjusting bolt 13, making the secondary piston 3 move upwardly under an action of the follower elastic element 11.

In some embodiments, when the control valve 6 is open, the oil supply line 5 supplies oil to the drive line 4-3 uni-directionally through the control valve 6.

In some embodiments, the oil supply line 5 includes a control oil supply line 5-1 and a drive oil supply line 5-2, the drive supply line 5-2 supplying oil uni-directionally to the oil drive line 4-3 through the control valve 6.

The control oil supply line 5-1 is used to provide different forces to the control valve 6 to realize opening or closing of the control valve 6 when internal oil pressure changes.

As shown in FIG. 9, merely by way of example, the control valve 6 includes a valve body 6-1, an elastic return element 6-2, and a one-way mechanism, the valve body 6-1 is provided with a primary oil line 6-13, a secondary oil line 6-11, and a connecting line 6-12. The valve body 6-1 is slidably mounted in the valve hole 17-1, the primary oil line 6-13 is connected to the secondary oil line 6-11 through the connecting line 6-12, and a one-way mechanism is provided in the connecting line 6-12 for allowing oil in the primary oil line 6-13 uni-directionally enter into the secondary oil line 6-11. The one-way mechanism includes an elastic element 6-4 and a one-way ball 6-5, the elastic element 6-4 may specifically be a compression spring, one end of which rests against an inner wall of the secondary oil line 6-11 and the other end of which rests against the one-way ball 6-5, and the one-way ball 6-5 rests against the connecting line 6-12 to prevent oil in the secondary oil line 6-11 from entering the primary oil line 6-13 through the connecting line 6-12. However, the one-way mechanism may allow the oil to flow from the primary oil line 6-13 to the secondary oil line 6-11 through the connecting line 6-12. It is worth noting that in other embodiments, a one-way valve may also be used directly in place of the one-way mechanism.

In some embodiments, the elastic return element 6-2 may be a compression spring for driving the valve body 6-1 to reset, one end of the elastic return element 6-2 resists against the valve body 6-1 and the other end resists against the rocker arm shaft 17 or a circlip mounted on the rocker arm shaft 17.

In some embodiments, an oil drain line 4-5 is provided in the actuator 4 or the rocker arm shaft 17, and the control oil supply line 5-1 and the elastic return element 6-2 are located at each end of the valve hole 17-1.

In some embodiments, as shown in FIG. 2, when pressure on the valve body 6-1 of oil passed into the valve hole 17-1 by the control oil supply line 5-1 is greater than an elastic force of the elastic return element 6-2, the valve body 6-1 is in an open position, and the drive oil supply line 5-2 is connected to the primary oil line 6-13, the secondary oil line 6-11 is connected to the oil drive line 4-3, and the oil drive line 4-3 is not connected to the oil drain line 4-5, in this state, the control valve 6 is open.

In some embodiments, as shown in FIG. 1, when the pressure on the valve body 6-1 of oil passes into the valve hole 17-1 by the control oil supply line 5-1 is less than the elastic force of the elastic return element 6-2, the elastic return element 6-2 drives the valve body 6-1 to move to a closed position, the drive oil supply line 5-2 is not connected to the primary oil line 6-13, and the secondary oil line 6-11 is not connected to the drive oil line 4-3, but is connected to the oil drain line 4-5, in this state, the control valve 6 is closed.

In some embodiments, a pressure relief chamber 6-3 is formed between the valve body 6-1 and the valve hole 17-1, and when the valve body 6-1 is in the closed position, the oil drive line 4-3 is connected to the oil drain line 4-5 through the pressure relief chamber 6-3.

In some embodiments, the pressure relief chamber 6-3 is provided on the valve body 6-1, and when the valve body 6-1 is in the closed position, the oil drive line 4-3 is connected to the oil drain line 4-5 through the pressure relief chamber 6-3.

In some embodiments, a valve actuator for a specialized stationary two-piston hydraulic engine operates as follows.

A camshaft of the engine drives a positive cam 18 and a specialized drive cam 19.

When a solenoid valve of the engine is closed, as shown in FIG. 1, the valve body 6-1 moves to the closed position under an action of the elastic return element 6-2, and the control valve 6 is in a closed state. The oil drive line 4-3 is drained and has no oil pressure inside, the primary piston 2 resets under an action of the active elastic element 8 and separates from the specialized drive cam 19, and the secondary piston 3 resets under an action of the follower elastic element 11 and separates from the follower pin 10. A drive lift of the specialized drive cam 19 is not transmitted, and only when the positive cam 18 is rotated to a primary lift cam 18-1 and contacts the positive rocker arm 1, the positive rocker arm 1 is rotated to displace the valve bridge 20, both the drive valve 15 and the non-drive valve 16 is opened to complete a usual valve positive lift.

When the solenoid valve of the engine opens, as shown in FIG. 2, the control oil supply line 5-1 fills a bottom of the valve hole 17-1, and the valve body 6-1 is pushed to the open position. The drive oil supply line 5-2 supplies oil uni-directionally to the oil drive line 4-3, a hydraulic leakage relationship is formed between the primary piston 2 and the secondary piston 3, and the primary piston 2 extends under hydraulic pressure to contact the specialized drive cam 19. As shown in FIG. 3, when the specialized drive cam 19 is rotated to the drive lift cam 19-2 to contact the primary piston 2, the drive lift cam 19-2 pushes the primary piston 2, and the secondary piston 3 then extends downwardly to contact and push the follower pin 10, then the drive valve 15 connected to the follower pin 10 is allowed to move and open, thereby realizing that the engine opens the drive valve 15 according to a lift of the specialized drive cam 19. As shown in FIG. 4, when the positive cam 18 begins to be rotated to the positive lift, the positive rocker arm 1 pushes the valve bridge 20 downwardly, and the drive valve 15 and the non-drive valve 16 achieve the positive lift.

In some embodiments, the valve actuator for the specialized stationary two-piston hydraulic engine may further include a pressure sensor, a displacement sensor, a pre-warning device, and a processor. The pressure sensor, the displacement sensor, the pre-warning device, and the foregoing device are all signalically connected to the processor.

The pressure sensor is used to detect pressure. In some embodiments, the pressure sensor is configured to obtain elastic force values of the active elastic element 8 and the follower elastic element 11. In some embodiments, at least two pressure sensors may be provided, and the active elastic element 8 and the follower elastic element 11 may be respectively provided with at least one pressure sensor.

The displacement sensor is configured to detect displacement change. In some embodiments, the displacement sensor is configured to obtain displacement change volumes of the active elastic element 8 and the slave elastic element 11. In some embodiments, at least two displacement sensors may be provided, and the active elastic element 8 and the follower elastic element 11 may be respectively provided with at least one displacement sensor.

The processor may be configured to receive data and analyze and process received data, generate a corresponding control instruction based on a processing result, and send the control instruction to an executing mechanism so that the executing mechanism performs corresponding actions. In some embodiments, the processor may record a pressure feature (e.g., the elastic force value detected by the pressure sensor) in chronological order to form a pressure feature sequence. The pressure feature sequence may include pressure features at one or more moments in one or more working cycles. In some embodiments, the processor may record a displacement feature (e.g., the displacement change volume detected by the displacement sensor) in chronological order to form a displacement feature sequence. The displacement feature sequence includes at least a sequence including displacement features at one or more moments in one or more working cycles. The working cycle refers to a time interval between each repetition of one or more actions of a structure that performs a cyclic movement in an engine. For example, a time interval between one or more reciprocating movements of a piston in the engine may be taken as the working cycle.

In some embodiments, the processor may determine an abnormality probability of the active elastic element 8 and an abnormality probability of the follower elastic element 11 based on the pressure feature sequence and the displacement feature sequence of the active elastic element 8 and the follower elastic element 11 for the one or more working cycles, and determine, based on the abnormality probability, whether or not to generate a pre-warning instruction. In some embodiments, the pre-warning instruction is configured to be sent to the pre-warning device to control the pre-warning device to issue pre-warning. The pre-warning device may include an audio device and a display device, and the pre-warning device may issue the pre-warning by sounding a human voice or a musical sound prompt through the audio device, or the pre-warning device may issue the pre-warning by displaying a cue through the display device. A user may respond to the pre-warning by repairing the valve actuator and replacing parts.

The abnormality probability is a failure probability corresponding to the active elastic element 8 and the follower elastic element 11, respectively. Failures may include, but are not limited to, abnormal temperatures, damage, effectiveness, etc.

In some embodiments, an embedding vector may be obtained based on the pressure feature sequence and the displacement feature sequence. For example, the pressure feature sequence and the displacement feature sequence may be input to an embedding model to obtain the embedding vector output by the embedding model. In some embodiments, the embedding model may be a machine learning model, which may be obtained based on training samples, trained in a plurality of feasible ways. In some embodiments, the embedding model may include a first embedding layer, a second embedding layer, and a third embedding layer, and the embedding vector may include a first embedding vector, a second embedding vector, and a third embedding vector, more descriptions may be found hereinafter.

In some embodiments, based on the embedding vector, matching is performed in a vector database to obtain one or more first target vectors whose similarity with the embedding vector satisfies a similarity threshold, and the abnormality probability of the active elastic element 8 as well as of the follower elastic element 11 may be obtained based on whether or not a failure occurs in history corresponding to a first target vector. In some embodiments, the vector database and the embedding model may be constructed by a remote server and pre-stored in a storage unit, which may be signally connected to the processor.

Merely by way of example, the embedding vector is matched in the vector database to obtain three first target vectors, which correspond to three situations, i.e., a failure of the active elastic element 8 actually occurred in history, the failure of the active elastic element 8 actually not occurred in history, and no failures occurred in history, so that the abnormality probability of a current active elastic element 8 may be 2/3, and the abnormality probability of the follower elastic element is 0.

Merely by way of example, the embedding vector is matched in a vector database to obtain three first target vectors, and the embedding vector and the three first target vectors correspond to similarity s1, similarity s2, and similarity s3, respectively, which correspond to three situations, i.e., the failure of the active elastic element 8 actually occurred in history, the failure of the active elastic element 8 actually not occurred in history, and no failures occurred in history, and the abnormality probability may be obtained based on similarity calculation. Specifically, the current abnormality probability of the active elastic element 8 is (s1+s2)/(s1+s2+s3) and the abnormality probability of the follower elastic element is 0 (0/(s1+s2+s3)).

Some embodiments of the present disclosure may obtain the elastic force value and the displacement change volume of the active elastic element 8 as well as of the follower elastic element 11 by providing the pressure sensor and the displacement sensor. The processor may determine the abnormality probability of the active elastic element 8 and the follower elastic element 11 according to a detection result of the pressure sensor and the displacement sensor. According to the abnormality probability, the processor may determine whether the pre-warning device needs to issue the pre-warning to prompt the user to deal with, parts that may have malfunction may be more accurately informed. Thus, processing may be performed in advance, which avoids serious consequences of the malfunction leading to damage to the valve actuator, etc.

In some embodiments, the valve actuator for the specialized stationary two-piston hydraulic engine may further include one or more sound sensors.

A sound sensor may be configured to detect a sound signal. In some embodiments, the sound sensor is configured to obtain a sound feature emitted during the operation of the valve actuator, e.g., the sound sensor may obtain the sound feature such as sound loudness, pitch, timbre, etc., during the operation of the valve actuator. In some embodiments, the one or more sound sensors may be deployed at one or more predetermined points in the valve actuator for the specialized stationary two-piston hydraulic engine. In some embodiments, the predetermined points may be points randomly set in the valve actuator or points set based on experience, e.g., there may be a plurality of predetermined points distributed near a location where the valve actuator makes a loud noise in operation. In some embodiments, the processor may record the sound feature (e.g., sound loudness, pitch, timbre, etc.) detected by the sound sensor in chronological order to form a sound data sequence. In some embodiments, the sound data sequence includes at least a sequence formed by sound features at one or more moments in one or more working cycles. Descriptions regarding the working cycle may be found hereinabove.

In some embodiments, the processor may also use the sound data sequence to determine the abnormality probability in a plurality of feasible ways. For example, the abnormality probability may be determined by looking up a predetermined relation table of the sound data with the abnormality probability, etc. In some embodiments, the abnormality probability may also be determined by determining a predicted friction loss based on the sound data sequence. Based on the predicted friction loss, the sound data sequence, the pressure feature sequence, and the displacement feature sequence, the abnormality probability is determined by a first probability prediction model, and the first probability prediction model is a machine learning model. The predicted friction loss is a predicted loss due to friction in the operation of the valve actuator, the greater the loss, the more likely to cause a failure on the valve actuator.

In some embodiments, the first probability prediction model may include a first embedding layer, a second embedding layer, a third embedding layer, a loss prediction layer, and a probability prediction layer. The first embedding layer, the second embedding layer, and the third embedding layer may be any one or a combination of a deep neural network (DNN) model, a convolutional neural network (CNN) model, etc., or any other customized model structure, etc. The loss prediction layer and probability prediction layer may be the deep neural network (DNN) model.

An input of the first embedding layer may include the pressure feature sequence and the displacement feature sequence of the active elastic element 8, and an output of the first embedding layer may include a first embedding vector.

An input of the second embedding layer may include the pressure feature sequence and the displacement feature sequence of the follower elastic element 11, and an output of the second embedding layer may include a second embedding vector.

An input of the third embedding layer may include sound data sequences at the one or more predetermined points, and an output of the third embedding layer may include a third embedding vector.

An input of the loss prediction layer is the output of the third embedding layer. The input of the loss prediction layer may include the third embedding vector, and an output of the loss prediction layer may include the predicted friction loss.

An input of the probability prediction layer is the output of the first embedding layer, the second embedding layer, the third embedding layer, and the loss prediction layer. The input of the probability prediction layer may include the first embedding vector, the second embedding vector, the third embedding vector, and the predicted friction loss, and the output of the probability prediction layer may include the abnormality probability.

In some embodiments, the first probability prediction model may be obtained by training based on a plurality of first training samples with first training labels, e.g., by joint training.

In some embodiments, a first training sample includes a sample pressure feature sequence and a sample displacement feature sequence of the active elastic element 8, a sample pressure feature sequence and a sample displacement feature sequence of the follower elastic element 11, and sample sound data sequences at one or more predetermined points, and the first training sample may be obtained based on historical data. A first training label may be an actual abnormality probability corresponding to a first sample condition. The actual abnormality probability may be obtained through statistical calculation by conducting a plurality of trials under the first sample condition and recording failure conditions. For example, if ten trials are performed under a certain identical condition, and the active elastic element 8 fails three times and the follower elastic element 11 does not fail, the actual abnormality probability of the active elastic element 8 is 3/10, and the actual abnormality probability of the follower elastic element 11 is 0. The first training label may be labeled manually.

Some embodiments of the present disclosure may determine a friction loss situation of the valve actuator based on noise of the valve actuator by providing the sound sensor to collect sound emitted during the operation of the valve actuator, and the abnormality probability may be obtained more accurately by combining the friction loss situation of the valve actuator through a machine learning model.

In some embodiments, the safety oil drain hole 4-6 may be provided with an adjustable stopper (which is not shown in the figures).

The adjustable stopper is used to cover or partially cover the safety oil drain hole 4-6, thereby changing area through which the safety oil drain hole 4-6 may pass. In some embodiments, the adjustable stopper may include a stopper and a motor element, the stopper is configured to block or partially block the safety drain oil hole 4-6, and the stopper may be tightly connected to an end face where the safety oil drain hole 4-6 is located. The motor element is connected to the stopper, and the motor element may push the stopper to move on the end face where the safety oil drain hole 4-6 is located to adjust the area through which the safety oil drain hole 4-6 may pass. In some embodiments, the motor element may be signally connected to the processor, and the processor may generate a control instruction to control the motor element.

In some embodiments, the processor is configured to determine, in response to the valve actuator for the specialized stationary two-piston hydraulic engine being in a hydraulic operation, a shading degree of the safety oil drain hole 4-6 by the adjustable stopper based on a displacement feature sequence and a pressure feature sequence for a current working cycle. The shading degree refers to a ratio of area of the safety oil drain hole 4-6 that is shaded by the stopper to area of the safety oil drain hole 4-6. In some embodiments, since there is a predetermined relationship between the shading degree and an oil drainage rate of the safety oil drain hole 4-6, the oil drainage rate may be detected by providing a flow rate sensor to obtain the shading degree according to the predetermined relationship.

In some embodiments, the processor may push the stopper for adjustment by controlling the motor element based on a determined shading degree, and by adjusting the shading degree, the oil drainage rate of the safety oil drain hole 4-6 may be controlled, thereby controlling a rate at which a hydraulic linkage is released between the primary piston 2 and the secondary piston 3.

In some embodiments, the processor may determine the shading degree by vector matching. Merely by way of example, based on the embedding vector output from the embedding model to match in a database of shading degree vectors, one or more second target vectors whose similarity with the embedding vectors satisfies a shading degree similarity threshold are obtained, and a shading degree of a current adjustable stopper is determined based on a historically selected shading degree corresponding to the second target vector. The one or more second target vectors refer to target vectors that have not experienced any failures for a subsequent longer time period. In some embodiments, the shading degree of the current adjustable stopper determined based on the historically selected shading degree corresponding to the one or more second target vectors, may be obtained based on similarity calculation. A manner for similarity calculation is the same as a manner for similarity calculation in determining the abnormality probability based on the first target vector, and may not be repeated here.

In some embodiments of the present disclosure, by providing the adjustable stopper and adjusting the adjustable stopper based on the determined shading degree, the oil drainage rate of the safety oil drain hole 4-6 may be controlled, thereby controlling the rate at which the hydraulic linkage is released between the primary piston 2 and the secondary piston 3.

In some embodiments, the processor may determine corresponding failure probabilities based on different candidate shading degrees, and based on the failure probabilities corresponding to the different candidate shading degrees, a corresponding candidate shading degree with a lowest failure probability is selected as an adopted shading degree.

In some embodiments, the processor may predict failure probabilities corresponding to different candidate shading degrees through a second probability prediction model, and the second probability prediction model is a machine learning model. In some embodiments, the second probability prediction model may be any one or a combination of a deep neural network (DNN) model, a convolutional neural network (CNN) model, etc., or other customized model structures, etc.

In some embodiments, an input of the second probability prediction model may include at least a displacement feature sequence and a pressure feature sequence of a current active elastic element 8, a displacement feature sequence and a pressure feature sequence of a current follower elastic element 11, a current shading degree, and a candidate shading degree, and an output of the second probability prediction model may be the failure probability.

Descriptions regarding the displacement feature sequence, the pressure feature sequence, and the shading degree may be found in the descriptions hereinabove. In some embodiments, the displacement feature sequence and the pressure feature sequence of the current active elastic element 8 may include a displacement feature and a pressure feature of the active elastic element 8 for a time that has elapsed in a current working cycle of the valve actuator. The displacement feature sequence and the pressure feature sequence of the follower elastic element 11 may include a displacement feature and a pressure feature of the follower elastic element 11 for the time that has elapsed in the current working cycle of the valve actuator. The shading degree may be a shading degree of the safety oil drain hole 4-6 by the adjustable stopper for the time that has elapsed in the current working cycle of the valve actuator. The failure probability refers to the failure probability corresponding to the active elastic element 8 as well as the follower elastic element 11, respectively.

In some embodiments, one or more candidate shading degrees may be randomly generated or obtained by randomly increasing or decreasing based on historical data. In some embodiments, the shading degree selected from the one or more candidate shading degrees may be used for remainder of the current working cycle of the valve actuator.

In some embodiments, the second probability prediction model may be obtained by training a plurality of second training samples with second training labels.

In some embodiments, a second training sample may at least include a displacement feature sequence and a pressure feature sequence of a sample current active elastic element 8, a displacement feature sequence and a pressure feature sequence of a sample current follower elastic element 11, a sample current shading degree, and a sample candidate shading degree. The second training sample may be obtained based on historical data. The second training label may be an actual failure probability under a second training sample condition. In some embodiments, the actual failure probability may be obtained by performing a plurality of trials under the second sample condition, recording failures, and calculating statistically, e.g., if five trials are performed under a same condition, one failure occurs in the active elastic element 8, and no failure occurs in the follower elastic element 11, the actual failure probability for the active elastic element 8 is 1/5, and the actual failure probability for the follower elastic element 11 is 0. The second training label may be manually labeled.

In some embodiments, a plurality of second training samples with second training labels may be input into an initial second probability prediction model, a loss function may be constructed from the second training label and results of the initial second probability prediction model, and parameters of the initial second probability prediction model may be iterated based on the loss function. When the loss function of the initial second probability prediction model satisfies a preset condition, model training is completed, and a trained second probability prediction model is obtained. The preset condition may be that the loss function converges, a count of iterations reaches a threshold, etc.

In some embodiments, the second probability prediction model may further include a first embedding layer and a second embedding layer. A displacement feature sequence and a pressure feature sequence of the active elastic element 8 for the current working cycle may be input into the first embedding layer. A displacement feature sequence and a pressure feature sequence of the follower elastic element 11 for the current working cycle may be input into the second embedding layer. The first embedding layer and the second embedding layer may output corresponding feature vectors, respectively, and the feature vectors respectively output by the first embedding layer and the second embedding layer may be input into the second probability prediction model along with a current shading degree and a candidate shading degree for the remainder of the current working cycle. Accuracy of an output result of the second probability prediction model may be further improved by setting the first embedding layer and the second embedding layer.

Some embodiments of the present disclosure may accurately determine a suitable shading degree by predicting the failure probabilities corresponding to the different candidate shading degrees through the second probability prediction model and designating a corresponding candidate shading degree with a lowest failure probability as an adopted shading degree, thereby reducing a failure probability of the valve actuator and prolonging a service life of the valve actuator.

Having thus described the basic concepts, it may be rather apparent to those skilled in the art after reading this detailed disclosure that the foregoing detailed disclosure is intended to be presented by way of example only and is not limiting. Although not explicitly stated here, those skilled in the art may make various modifications, improvements, and amendments to the present disclosure. These alterations, improvements, and modifications are intended to be suggested by this disclosure and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure, or feature described in connection with the embodiment is included in at least one embodiment of the present disclosure. Therefore, it is emphasized and should be appreciated that two or more references to "an embodiment" or "one embodiment" or "an alternative embodiment" in various portions of the present disclosure are not necessarily all referring to the same embodiment. In addition, some features, structures, or characteristics of one or more embodiments in the present disclosure may be properly combined.

In some embodiments, the numbers expressing quantities or properties used to describe and claim certain embodiments of the present disclosure are to be understood as being modified in some instances by the term "about," "approximate," or "substantially." For example, "about," "approximate" or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the present disclosure are approximations, the numerical values set forth in the specific examples are reported as precisely as practicable.

What is claimed is:

1. A valve actuator for a specialized stationary two-piston hydraulic engine, comprising:

a specialized drive cam, disposed on a side of a positive cam of the engine, with a round base component and a drive lift cam disposed on the round base component, the positive cam being used to displace a valve bridge by means of a positive rocker arm;

an actuator, provided with a primary piston slidably mounted in a primary piston hole and a secondary piston slidably mounted in a secondary piston hole;

an oil drive line, maintained in communication between the primary piston hole and the secondary piston hole; and a control valve, the oil drive line being connected to an oil supply line through the control valve;

in a condition in which the oil supply line supplies oil to the oil drive line and the control valve is open, when the specialized drive cam is rotated to the round base component for sliding or rolling engagement with the primary piston, the primary piston extending under hydraulic pressure of the oil drive line to contact the round base component; and when the specialized drive cam is rotated to the drive lift cam for sliding or rolling engagement with the primary piston, the control valve blocking the oil drive line from the oil supply line, and a hydraulic linkage being formed between the primary piston and the secondary piston, and the drive lift cam displacing the secondary piston through the primary piston so that the secondary piston provides power for a drive valve of the engine to move relative to the valve bridge; and in a condition in which the control valve is closed, the oil drive line being drained through the control valve, and the hydraulic linkage between the primary piston and the secondary piston being released.

2. The valve actuator for a specialized stationary two-piston hydraulic engine according to claim 1, wherein the valve actuator is fixedly connected to a rocker arm shaft.

3. The valve actuator for a specialized stationary two-piston hydraulic engine according to claim 2, wherein the valve actuator is provided with a shaft hole matching the rocker arm shaft, the rocker arm shaft passes through the shaft hole, the valve actuator is connected to a positioning pin, and the valve actuator is fixedly connected to the rocker arm shaft through the positioning pin.

4. The valve actuator for a specialized stationary two-piston hydraulic engine according to claim 2, wherein the valve actuator is provided with an active elastic element, the active elastic element being used to drive the primary piston to retract when the oil drive line is drained.

5. The valve actuator for a specialized stationary two-piston hydraulic engine according to claim 2, wherein the valve actuator is provided with a follower elastic element, the follower elastic element being used to move the secondary piston in a direction away from the drive valve, the follower elastic element being capable of overcoming oil pressure on the secondary piston during filling of the oil drive line, maintaining the secondary piston in a retracted position, and driving the secondary piston to retract during draining of the oil drive line.

6. The valve actuator for a specialized stationary two-piston hydraulic engine according to claim 5, wherein a safety oil drain hole is provided on an inner peripheral wall of the secondary piston hole;

when the secondary piston moves between a retracted position and a maximum extended position, the secondary piston blocks the safety oil drain hole and the oil drive line is not connected to the safety oil drain hole; and when the secondary piston moves beyond the maximum extended position, the secondary piston does not block the safety oil drain hole, and the oil drive line is connected to the safety oil drain hole through the secondary piston hole.

7. The valve actuator for a specialized stationary two-piston hydraulic engine according to claim 5, further comprising a follower pin provided opposite to the secondary piston, the drive valve being connected to the follower pin; and in a condition in which the oil supply line supplies oil to the oil drive line and the control valve is open, when the specialized drive cam is rotated to the round base component for sliding or rolling engagement with the primary piston, the secondary piston being separated from the follower pin; and when the specialized drive cam is rotated for sliding or rolling engagement with the primary piston, the secondary piston moving until contacting with the follower pin and displacing the drive valve by pushing through the follower pin.

8. The valve actuator for a specialized stationary two-piston hydraulic valve engine according to claim 1, wherein the actuator is provided with an adjusting bolt for adjusting a position of the secondary piston.

9. The valve actuator for a specialized stationary two-piston hydraulic engine according to claim 1, wherein the control valve is open, the oil supply line supplies oil to the oil drive line uni-directionally through the control valve.

10. The valve actuator for a specialized stationary two-piston hydraulic engine according to claim 9, wherein the oil supply line includes a control oil supply line and a drive oil supply line, the drive oil supply line supplying oil uni-directionally to the oil drive line through the control valve; and the control oil supply line is used to provide different forces to the control valve to realize opening or closing of the control valve when internal oil pressure changes.

11. The valve actuator for a specialized stationary two-piston hydraulic engine according to claim 10, wherein the control valve includes a valve body, an elastic return element, and a one-way mechanism, the valve body being provided with a primary oil line, a secondary oil line, and a connecting line, the valve body being slidably mounted in a valve hole, the primary oil line being connected to the secondary oil line through the connecting line, the one-way mechanism being provided in the connecting line for permitting unidirectional entry of oil in the primary oil line into the secondary oil line, the elastic return element being used for driving the valve body to reset;

an oil drain line is provided in the valve actuator or the rocker arm shaft, the control oil supply line being connected to an end of the valve hole;

when pressure on the valve body of oil passed into the valve hole by the control oil supply line is greater than an elastic force of the elastic return element, the valve body is in an open position, the drive oil supply line is connected to the primary oil line, the secondary oil line is connected to the oil drive line, and the oil drive line is not connected to the oil drain line; and when the pressure on the valve body of oil passed into the valve hole by the control oil supply line is less than the elastic force of the elastic return element, the elastic return element drives the valve body to move to a closed position, and the oil drive line is connected to the oil drain line.

12. The valve actuator for a specialized stationary two-piston hydraulic engine according to claim 11, wherein a pressure relief chamber is formed between the valve body and the valve hole, and when the valve body is in the closed position, the oil drive line is connected to the oil drain line through the pressure relief chamber; or the valve body is provided with the pressure relief chamber, and when the valve body is in the closed position, the oil drive line is connected to the oil drain line through the pressure relief chamber.

13. The valve actuator for a specialized stationary two-piston hydraulic engine according to claim 1, wherein the control valve is mounted on the rocker arm shaft or the valve actuator.

* * * * *